United States Patent [19]

Magnin et al.

[11] Patent Number: 4,892,685

[45] Date of Patent: Jan. 9, 1990

[54] PROCESS FOR THE IMMOBILIZATION OF ION EXCHANGE RESINS ORIGINATING FROM RADIOACTIVE PRODUCT REPROCESSING PLANTS

[75] Inventors: Guy Magnin; Marie-Françoise Champeaud, both of Plaisir; Véronique Aubert, Les Clayes-sous-Bois; Claude Jaouen, Guyancourt, all of France

[73] Assignee: Societe Generale Pour Les Techniques Nouvelles S.G.N., France

[21] Appl. No.: 157,038

[22] Filed: Feb. 16, 1988

[30] Foreign Application Priority Data

Dec. 16, 1987 [FR] France ..... 87 17595

[51] Int. Cl.[4] ..... G21F 9/16

[52] U.S. Cl. ..... 252/628; 106/90; 106/111

[58] Field of Search ..... 252/628, 631; 210/661, 210/638, 682, 751, 749; 106/90, 93, 94; 376/313; 423/7

[56] References Cited

U.S. PATENT DOCUMENTS

| | | | |
|---|---|---|---|
| 4,122,048 | 10/1978 | Buchwalder | 521/26 |
| 4,299,722 | 11/1981 | Stock et al. | 252/628 |
| 4,401,591 | 8/1983 | Korostenski | 252/629 |
| 4,483,789 | 11/1984 | Kunze et al. | 252/628 |
| 4,530,723 | 7/1985 | Smeltzer et al. | 106/90 |
| 4,537,710 | 8/1985 | Komarneni et al. | 252/628 |
| 4,663,086 | 5/1987 | Lefillatre | 252/628 |
| 4,671,898 | 6/1987 | Hultgren | 252/628 |
| 4,770,783 | 9/1988 | Gustavsson et al. | 210/638 |

FOREIGN PATENT DOCUMENTS 8212465 4/1982 United Kingdom .

*Primary Examiner*—Howard J. Locker

*Attorney, Agent, or Firm*—Poms, Smith, Lande & Rose

[57] ABSTRACT

The present invention relates to a process for the immobilization of ion exchange resins originating from radioactive product (waste) reprocessing plants, the said resins being immobilized in a cement, preferably of the CLK type, wherein, before immobilization in the said cement, the said resins are treated with an aqueous solution containing $NO_3^-$ and $Na^+$ ions, the quantity of $NO_3^-$ ions in the said aqueous solution being calculated so as to ensure that all the sites in the resins are saturated, assuming that all the resins treated are of anionic type and that the quantity of $Na^+$ ions used in the said aqueous solution, or added in a second step, ensures on the one hand that the medium has a basic pH and on the other hand that all the sites in the cationic resins are saturated.

5 Claims, No Drawings

PROCESS FOR THE IMMOBILIZATION OF ION EXCHANGE RESINS ORIGINATING FROM RADIOACTIVE PRODUCT REPROCESSING PLANTS

The present invention relates to a process for the immobilization of ion exchange resins originating from radioactive product reprocessing plants.

It is known that in radioactive product (waste) reprocessing plants, which particularly have cooling ponds for unloading and storing irradiated fuel, ion exchange resins are used to purify the water in the said cooling ponds to a certain extent.

These ion exchange resins have the following characteristics: they are of both anionic and cationic types, they are in the form of beads or powders, they essentially possess (when they are to be immobilized according to the invention) exchange sites consisting of $OH^{-0}$ and $H^+$ ions, they are free of borates and they have a certain level of radioactivity.

After use, these ion exchange resins must therefore be immobilized for storage. It is known that the products obtained by this immobilization and the storage conditions are subject to a number of rules laid down by the Authority, and these rules should of course be observed. The expression "The Authority" (i.e., the administration) as used in this specification designates the French Authorities who enact safety regulations in France.

It has already been recommended to immobilize resins of this type by incorporating them in a thermosetting resin at room temperature after having treated them with a basic compound such as sodium hydroxide, aqueous ammonia, lime, aluminum chloride, sodium acetate, sodium citrate, sodium oxalate or an amine.

Furthermore, it has also been recommended to immobilize resins of this type by incorporating them in a hydraulic binder after having pretreated them with lime.

It will be noted that, as regards the pretreatment claimed, each of these processes is specific for the material in which the resins are immobilized, and that the said processes are described in the context of immobilizing resins of cationic type. These processes do not make provision for the specific problems which arise when mixtures of cationic and anionic resins are to be immobilized.

The present invention relates to a process for the immobilization of the said mixtures, the industrial application of this process being sufficiently reliable and reproducible to enable an immobilized material to be produced which complies with the standards imposed by the Authority.

The general immobilization process selected was concreting, i.e. the process which uses a hydraulic binder. In view of this choice, the problem was therefore to find a resin pretreatment process which made it possible to immobilize the resins in the said hydraulic binder under the best conditions.

In the pretreatment process according to the invention, the ion exchange resins to be immobilized are treated with an aqueous solution containing $NO_3^-$ and $Na^+$ ions, the quantity of $NO_3^-$ ions in the said aqueous solution being calculated so as to ensure that all the sites in the resins are saturated, assuming that all the resins treated are of anionic type and that the quantity of $Na^+$ ions used in the said aqueous solution, or added in a second step, ensures on the one hand that the medium has a basic pH and on the other hand that all the sites in the cationic resins are saturated.

In the process according to the invention, the calculation of the total quantity of $Na^+$ ions to be used can advantageously be performed assuming that all the resins treated are of cationic type.

Of course, in a preferred embodiment of the invention, the $NO_3^-$ and $Na^+$ ions are introduced in the form of a concentrated solution of sodium nitrate and, if appropriate, the additional $Na^+$ ions required are introduced in the form of sodium hydroxide.

When the resins have undergone the pretreatment according to the invention, an appropriate amount of cement, preferably of the CLK type, and, if appropriate, water are added. CLK type cement is a cement with low hydrating heating power. It contains a high quantity of slurry (over 80% by weight) to the detriment of the clinker (less than 17 weight percent), the remainder being additives. CLK type cement corresponds to a blast furnace cement which, according to United States standards, contains 25 to 65% weight slurry. The characteristids of CLK cement are well known.

The pretreatment according to the invention may be carried out either in a column or in a continuous mixer.

A procedure for carrying out the invention will be described below by way of a non-limiting example.

When the batch of ion exchange resin to be treated is received, a quick evaluation is made to determine the proportion of solid (resin) and liquid (water) contained in the batch. It was found, for example, that the said batch contained 100 l of 100% decanted ion exchange resins and 10 l of rinsing water. In the present text, resins obtained by decanting the resin suspension and removing the supernatant are called 100% decanted resins.

This batch is transferred to a mixer and stirred.

25 l of an $NO_3Na$ solution containing 500 g/l are added to the said batch and the resulting solution is stirred for a few minutes. The amount of $NO_3Na$ added corresponds to saturation of all the sites in the resin by $NO_3^-$, assuming that the batch consists only of anionic resins.

When stirring and decantation are complete, a sample of the supernatant is taken for measurement of its pH. It it is basic, 200 kg of CLK cement are added to the mixture, with stirring. If the said pH is acid, 10 kg of NaOH crystals are added to the mixture, with stirring; this amount of NaOH was calculated so as to completely saturate the sites in the resin, assuming that the charge consists only of cationic resins. It will be noted that smaller amounts of NaOH can be used, but this creates the risk that some of the cationic resin sites will not be saturated with $Na^+$, leading to inferior results in terms of the immobilized products obtained. After this addition of NaOH and after cooling, if appropriate, 200 kg of CLK cement are added.

The mass obtained in this experiment is of the order of 350 kg, i.e. about 200 l. The coated material contains about 50% by volume of ion exchange resins (100% decanted).

The procedure described above can of course be modified without going outside the framework of the invention. Thus, the following possibilities will be mentioned:

In the case where the initial mixture of resins to be treated definitely contains a very high proportion of cationic resins and consequently the suspension will definitely have an acid pH after treatment with $NO_3Na$, it is perfectly possible to add the sodium hydroxide at the same time as the sodium nitrate. The amounts of sodium hydroxide and sodium nitrate will be calculated as indicated above.

It is perfectly possible to carry out the treatment according to the invention using a nitric acid solution on the one hand and a sodium hydroxide solution on the other.

In the process described, it is clear that, when the cement is added, those skilled in the art will have to ensure that the mixture to which the said cement is added contains the appropriate amount of water for the said cement to set. This amount of water may originate wholly or partly from the water initially present with the batch of resins to be treated and, if appropriate, from the rinsing water, wholly or partly from the water in the ionic solution (or solutions) used ($NO_3^-$ and $Na^+$) and/or wholly or partly from water which is added, if appropriate, at the same time as the cement. In other words, if, as is most often the case (particularly in view of the inherent radioactivity), the water present with the batch of resin to be treated is itself included in the final mixture, it is possible, if there are on-site facilities for disposing of the water initially present with the resins and the effluents from any treatment carried out on the resins, to obtain a final block with characteristics superior to those obtained in the process in which the resin and water together are cemented.

What is claimed is:

1. A process for the immobilization of ion exchange resins originating from radioactive product reprocessing plants, wherein said resins are immobilized in a cement and wherein, before immobilization in the said cement, said resins are treated with an aqueous solution containing $NO_3^-$ and $Na^+$ ions, the quantity of $NO_3^-$ ions in the said aqueous solution being calculated so as to ensure that all the sites in the resins are saturated, and that the quantity of $Na^+$ ions used in the said aqueous solution ensures that the medium has a basic pH and that all the sites in the cationic resins are saturated.

2. The process as claimed in claim 1, wherein the aqueous solution containing $NO_3^-$ and $Na^+$ ions is a concentrated solution of sodium nitrate.

3. The process as claimed in claim 2, wherein additional $Na^+$ ions are introduced in the form of sodium hydroxide.

4. The process as claimed in claim 1, wherein nitric acid and sodium hydroxide solutions are used to provide said $NO_3^-$ and $Na^+$ ions.

5. A process according to claim 1 wherein said cement is CLK type cement.

* * * * *